US005992562A

United States Patent [19]

Boeckman et al.

[11] Patent Number: 5,992,562

[45] Date of Patent: Nov. 30, 1999

[54] SCISSOR LIFT CONTROL APPARATUS

[75] Inventors: Brian M. Boeckman, Chambersburg; Lex A. Mellott, Warfordsburg, both of Pa.

[73] Assignee: JLG Industries, Inc., McConnellsburg, Pa.

[21] Appl. No.: 08/592,181

[22] Filed: Jan. 26, 1996

[51] Int. Cl.[6] ..... B66F 11/04

[52] U.S. Cl. ..... 182/63.1; 182/69.5

[58] Field of Search ..... 182/2.1, 2.11, 182/69.4–69.6, 63.1

[56] References Cited

U.S. PATENT DOCUMENTS

| | | | |
|---|---|---|---|
| 3,854,610 | 12/1974 | Carder | 214/520 |
| 3,920,096 | 11/1975 | Fisher | 182/63 |
| 4,252,213 | 2/1981 | Ekman | 182/2 |
| 4,456,093 | 6/1984 | Finley | 182/19 |
| 4,501,939 | 2/1985 | Hyltin et al. | 200/6 |
| 4,519,042 | 5/1985 | Minamida et al. | 364/567 |
| 4,522,548 | 6/1985 | Oswald et al. | 414/458 |
| 4,526,346 | 7/1985 | Galloway et al. | 254/122 |
| 4,598,797 | 7/1986 | Schultz | 187/9 |
| 4,643,074 | 2/1987 | Gunda et al. | 91/361 |
| 4,662,809 | 5/1987 | Sturtz et al. | 414/347 |
| 4,679,653 | 7/1987 | Pasquarette | 182/2.4 |
| 4,691,805 | 9/1987 | Kishi | 187/9 |
| 4,762,199 | 8/1988 | Holmes | 182/2 |
| 4,833,615 | 5/1989 | Bitner et al. | 364/463 |
| 4,844,685 | 7/1989 | Sagaser | 414/750 |
| 4,904,916 | 2/1990 | Gisske | 182/2.9 |
| 4,909,696 | 3/1990 | Wigley | 414/287 |
| 4,946,340 | 8/1990 | Murphy et al. | 414/788.8 |
| 4,995,772 | 2/1991 | Biggio | 414/458 |
| 5,011,358 | 4/1991 | Andersen et al. | 414/273 |
| 5,021,917 | 6/1991 | Pike | 182/2.11 |
| 5,083,892 | 1/1992 | Oswald et al. | 414/454 |
| 5,121,816 | 6/1992 | Curtin | 187/9 R |
| 5,274,311 | 12/1993 | Littlejohn et al. | 318/562 |
| 5,359,542 | 10/1994 | Pahmeier et al. | 364/461 |
| 5,609,220 | 3/1997 | Moriya | 180/253 |

FOREIGN PATENT DOCUMENTS

| | | |
|---|---|---|
| 0 285 710 | 10/1988 | European Pat. Off. . |
| 2 675 494 | 10/1992 | France . |
| 2 244 742 | 12/1991 | United Kingdom . |

*Primary Examiner*—Alvin Chin-Shue
*Attorney, Agent, or Firm*—Foley & Lardner

[57] ABSTRACT

A controller for a scissor lift control system includes a multiplexing device for lessening the number of conductor lines sent to the controller. The controller includes a microprocessor, and it determines appropriate safe operations of the scissor lift based on various sensed inputs, such as height of the platform and load on the platform. The scissor lift is operated by pushing either a drive select push button, a lift select push button, or a deck select push button. After the switch is selected, the operator has a predetermined amount of time to stroke the joystick in order to effect movement of the scissor lift.

18 Claims, 9 Drawing Sheets

24v
EMS
Drive Sel.
Lift Sel.
Deck Sel.
Dir B
Dir A
Positrac
High Drive
Spare
MUX Device
1
2
3
4
5
6
7
8
520
525
572
574
560
Inter-face
1
2
576
578
580
582
584
586
588
590
592
594
596
598
3
4
5
6
7
8
9
10
11
12
13
14
Steer Right
Steer Left
Tilt Light
Alarm Platform
Lift Light
Drive Light
Deck Light
24 V to Controller
Gnd from Controller
Accelerator
510
Spare
Spare
To Controller 600

SCISSOR LIFT CONTROL APPARATUS

BACKGROUND OF THE INVENTION

1. Field of the Invention

The invention relates to a microprocessor-based control system for a scissor type aerial work platform. More particularly, the invention relates to the use of a microprocessor-based control system for a scissor type aerial work platform which allows a reduction in the number of components required in the control function. The invention also relates to a multiplexing device which reduces the number of conductors required in the control system.

2. Description of the Related Art

Work Platforms are utilized for a variety of different uses, such as: a) loading and unloading of items in a warehouse, and b) repairing components located at a particular elevation, such as repairing a broken ceiling light in a gymnasium. FIG. 1*a* shows a conventional work platform which can be used at a warehouse, for example. The work platform, which in this case is shown as a scissor type aerial work platform 10, can be used to move large boxes from one location to another, or it can be used to move a worker to a particular location as the work platform 10 is raised or lowered to a particular height. The work platform 10 includes a base portion 20 and a vertically movable platform portion 30 (also called "aerial work platform").

One important aspect of aerial work platforms is the control of the movement of the movable platform 30 with respect to the base portion 20. Typically, this is done by monitoring inputs made by an operator, and by raising or lowering the movable platform 30, extending or retracting a deck on the movable platform 30, or driving the work platform 10 based on the particular operator input. FIG. 1*b* shows the same work platform 10 as in FIG. 1*a*, but with a deck 40 extended on the movable platform 30, thereby allowing an operator on the movable platform 30 greater range of movement.

U.S. Pat. No. 5,274,331, to Littlejohn et al., shows a system in which network communication concepts are applied to a motor and/or motion control system. Specifically, a wheelchair control is shown in the Littlejohn et al. reference, in which three modules are interconnected by an RS-485 bus. The modules are: a) a user command module, b) a motherboard controller module, and c) a drive motor controller module. In the Littlejohn et al. system, commands entered at the command module are transmitted to the motherboard controller through the bus. The motherboard controller communicates with the motor controller through the bus.

U.S. Pat. No. 4,519,042, to Minamida et al., shows a method for checking the operation of a combinatorial weight measuring apparatus to determine whether weighing machines and a microcomputer which determines the optimum combination of objects are operating properly. Also shown in Minamida's system is a multiplexer which is used for communicating information from a plurality of controlled elements, i.e., weighing machines, to a microcomputer.

U.S. Pat. No. 4,691,805, to Kiski, shows a lifting apparatus in which a number of functions are controlled by software. These functions include the extension of a stretchable boom, inclination of the stretchable boom, and the orientation of a work platform at the end of the boom.

U.S. Pat. No. 5,011,358, to Andersen et al., shows a controller for a forklift, which compares programmed store and retrieve heights for various shelves in a warehouse with the current height of the fork. The Andersen et al. system also displays to the operator an indication when the fork is at or within a predetermined range of the store or retrieve height of the shelf.

None of the above systems show a device which can accommodate both analog and digital inputs to control an aerial type work platform in an expedient manner, nor do they show a device that can receive various sensor inputs as well as platform and ground select inputs to control a plurality of valves to actuate a particular work platform function.

Further, each of the above-mentioned systems uses external relays and diodes to provide the needed control of the work platform. The various control devices are not centrally located, and do not use solid-state components for the control function of the work platform.

SUMMARY OF THE INVENTION

It is an object of the invention to provide a solid-state system for controlling a scissor type aerial work platform.

It is a further object of the invention to provide a means for operating the work platform in a safe mode of operation based on various sensed inputs obtained from the work platform.

It is still another object of the invention to provide a means for operating the work platform using momentary membrane push buttons and a joystick, to effect at least one of a drive mode, a lift mode, and a deck mode.

These and other objects are accomplished by a controller for a work platform having a base section and a movable platform section. The controller includes means for receiving a plurality of sensed inputs of a state of the work platform, the state including at least one of a load on the work platform, a height of the movable platform section, and an angular position of the work platform. The controller also includes means for allowing operator inputs to operate the work platform from one of a ground control station located on the base section and a platform control station located on the movable platform section. The controller further includes means, responsive to the received sensed inputs and the operator inputs, for operating the work platform in one of a plurality of predetermined conditions, whereby any of the predetermined conditions allow safe operation of the work platform.

These objects are also accomplished by a platform control station on a movable platform section of a work platform which also includes a base section. The platform control station includes a joystick operable in a single-axis direction, with the joystick positioned in a central position when not operated by an operator. The platform control station also includes means for providing a first signal when the joystick is moved in a first direction along the single-axis direction, and for providing a second signal when the joystick is moved in a second direction along the single-axis direction, the second direction being opposite the first direction. The platform control station further includes a drive select push button, a lift select push button, and a deck select push button. The platform control station even still further includes a rocker switch positioned on a top portion of the joystick, with the rocker switch positioned in one of a first state and a second state when operated by the operator, and with the rocker switch positioned in a third state indicating a non-operational condition when not operated by the operator. With the above-described platform control station, when one of the drive select push button, lift select push button, and deck select push button are selected by the operator, the operator has a predetermined amount of time in order to engage the joystick in order to effect movement of the work platform.

These and other objects are also accomplished by using a method for controlling movement of a work platform having a movable platform section with a retractable deck. The method includes a step of receiving operator inputs on a platform control station housed at the movable platform section to request one of drive movement, lift movement and deck movement of the work platform. The platform further includes a step of receiving sensed inputs on a plurality of locational conditions of the work platform, including height of the movable platform section. Lastly, based on the received sensed inputs, the method includes a step of either allowing, disallowing, or allowing in a cut back state the request based on the received operator inputs.

BRIEF DESCRIPTION OF THE DRAWINGS

These and other objects and advantages of the invention will become more fully apparent from the following detailed description when read in conjunction with the accompanying drawings, with like reference numerals indicating corresponding parts throughout, wherein.

DETAILED DESCRIPTION

One example of the system according to the invention uses a microprocessor-based controller, which is designed specifically for the functions of a scissor-lift aerial work platform, but which can be easily reprogrammed or reconfigured to control other types of work platforms, such as a boom-type platform. A system according to the invention can also include a platform control station, ground control station, electric motor, and control valves, all of which are monitored and controlled by the microprocessor. In a system according to the invention, all of the conventional electrical components used for control, such as relays and diodes, can be converted to solid state devices in the controller module. The microprocessor can be configured to control all functional inputs and outputs individually, and to provide a fail safe mode of operation of the scissor type aerial work platform.

Figure 1A:
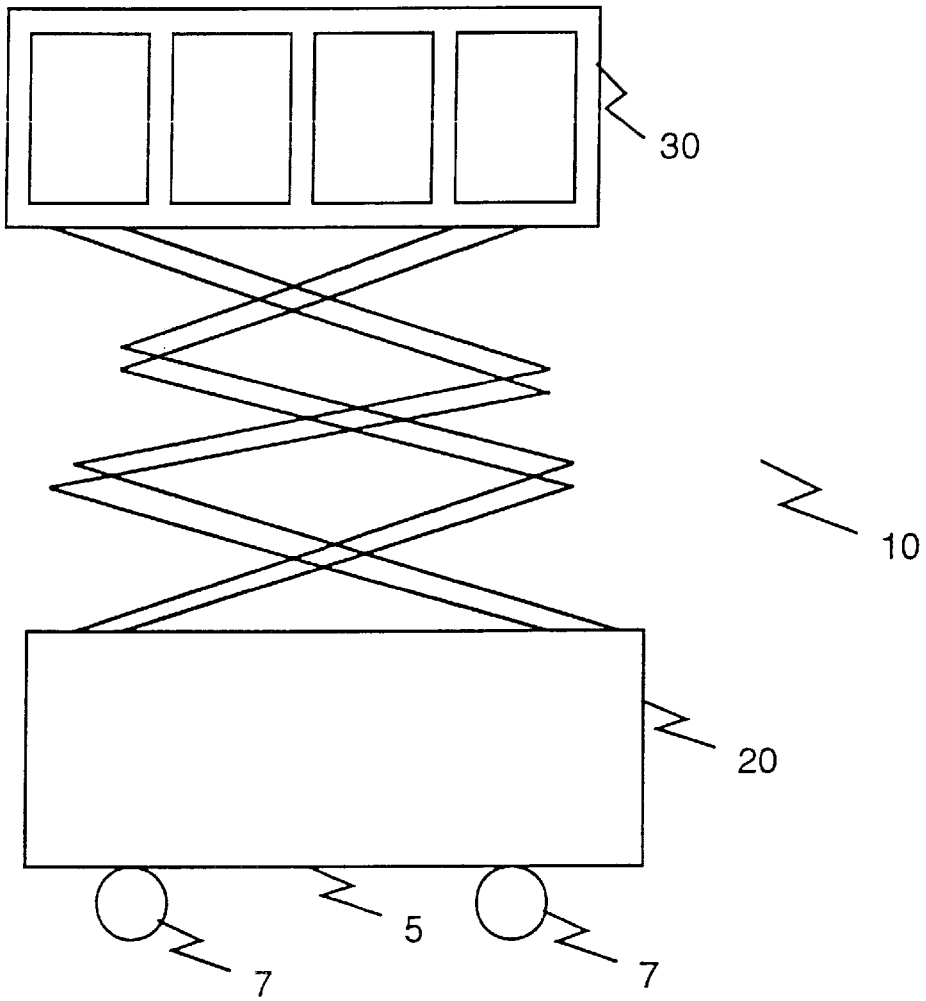
FIG. 1*a* depicts a side view of a scissor type aerial work platform which can be controlled using a system according to the invention.
Figure 1B:
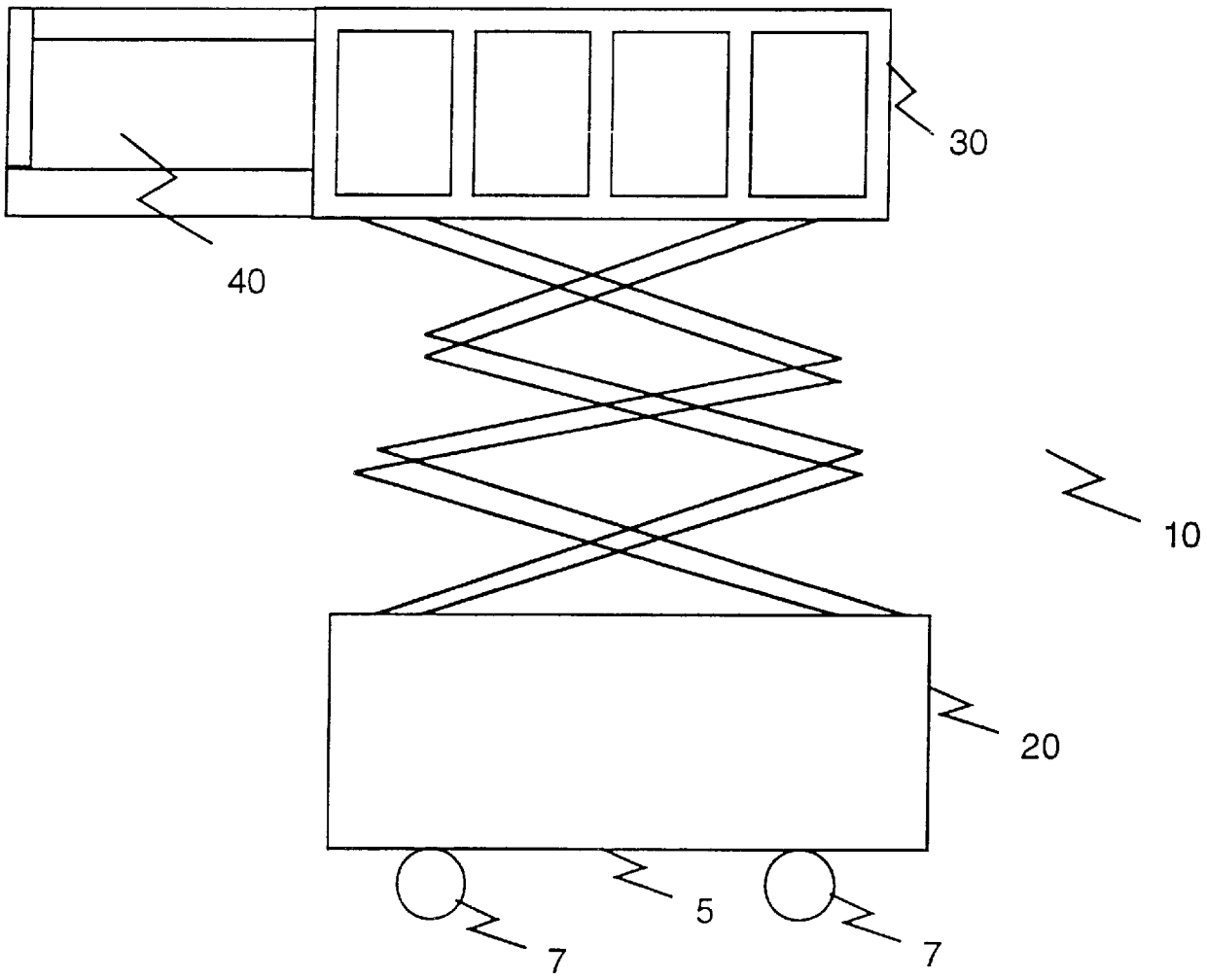
FIG. 1*b* depicts a side view of the scissor type aerial work platform, with a deck extended on the movable platform.
Figure 2:
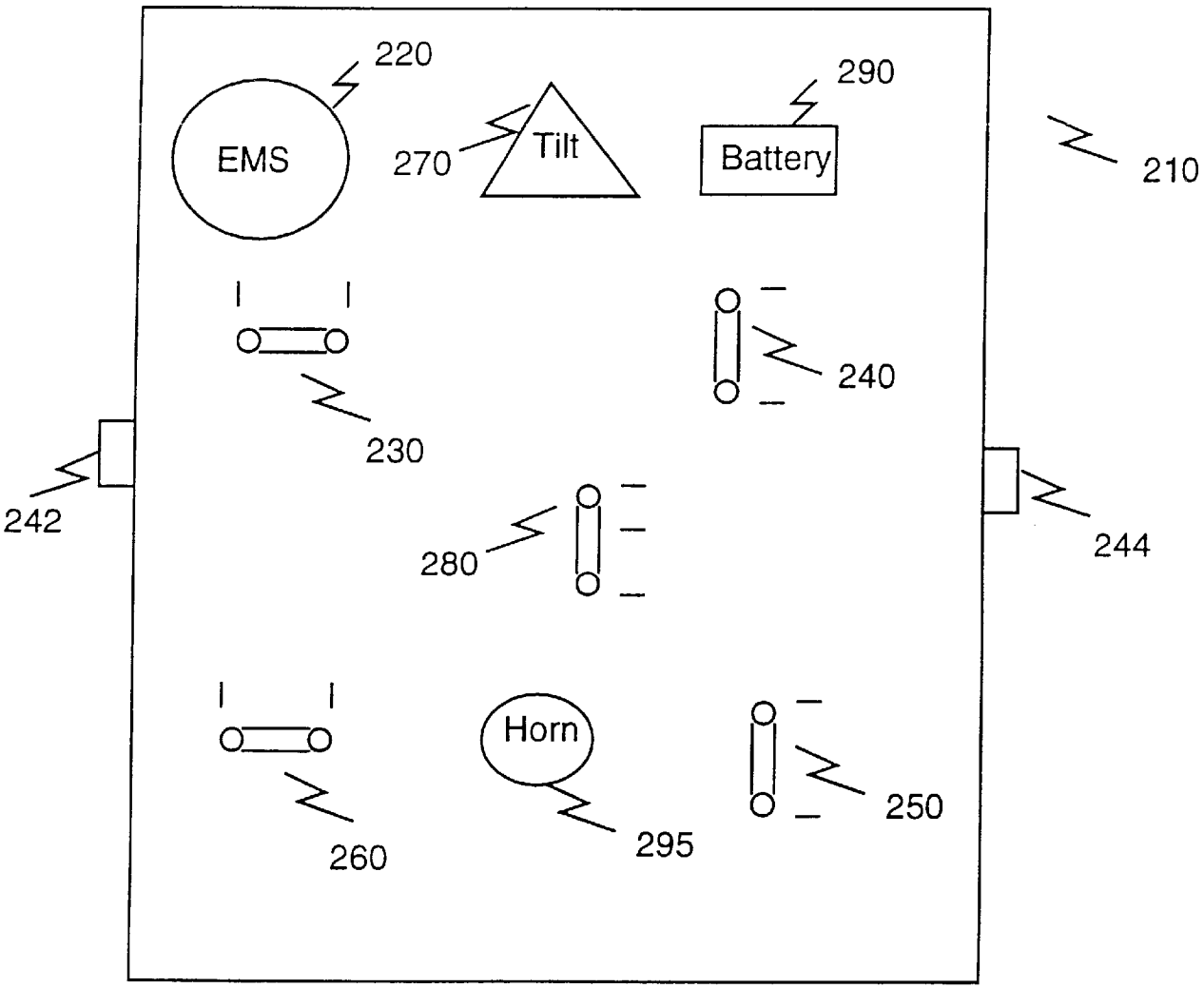
FIG. 2 is a plan view of a conventional platform control station for a scissor type aerial work platform.

A conventional platform control station 210 for a scissor-type aerial work platform is shown in FIG. 2. The platform control station 210 is located in the movable platform portion 30 of the work platform (see FIG. 1). In FIG. 2, there is shown an emergency button 220 for disabling power to the aerial work platform, thereby providing an emergency stop capability. There are also shown three separate spring-loaded switches 230, 240 and 250 that are movable to either a forward position or a reverse position. Switch 230 is for moving the aerial platform 30 in the vertical direction. Switch 240 is for moving a deck 40 in or out with respect to the movable platform 30. The deck extends from one end of the movable platform, as shown in FIG. 1*b*. Referring back to FIG. 2, switch 250 is for driving the work platform 10 in either a forward or reverse direction. When switch 250 is moved when in the drive mode, the wheels 7 on the base portion 20 of the work platform 10 are rotated to effect movement of the work platform 10. Each of the switches 230, 240 and 250 is spring loaded such that when the operator releases a switch, the switch returns back to the center (deactivated) position.

There is also provided a fourth spring-loaded switch 260, which is movable in either a left or right direction, and which is used to provide a steering capability for the work platform 10. In one example, referring now to FIG. 1*a,* the front wheels 7 turn in an appropriate direction to effect a turning movement of the work platform 10 when the steering function is activated. Also shown in the platform control station 210 in FIG. 2 is a tilt light indicator 270, which lights up when the aerial type work platform exceeds a predetermined tilt angle. This is used to indicate a potential safety hazard to the operator. Another switch 280, which can be set to one of three positions, allows for one of three drive modes: a) a normal drive condition when set to the middle position, b) a high drive condition when set to the top position, and c) a creep speed condition when set to the bottom position.

On the left side of the platform control station 210 is an enable button 242. The operator must first press the enable button 242, and then toggle one of the switches 230, 240, 250 within three seconds after the enable button 242 was pressed in order to enter the respective lift, deck or drive mode for the work platform 10. For example, if the operator toggles the drive switch 250 without having pressed the enable button no later than three seconds before, then the drive mode will not be entered.

On the right side of the platform control station 210 is a positrac (two-wheel drive) button 244. When the wheels of the work platform 10 are spinning during the drive mode, the operator may want to enter the positrac mode. To enter the positrac mode, the operator presses and holds the positrac button 244 while in the drive mode. The positrac mode will be maintained for as long as the positrac button 244 is held down.

On the top of the platform control station 210 is located a horn device 295, which activates a horn when pushed. Lastly, there is a battery indicator 290, which is used to indicate whether a battery is sufficiently charged to provide power to run the aerial type work platform. When lit, the battery is below a predetermined charge, which indicates to the operator that the battery needs to be recharged. In the conventional platform control device, there does not exist a means for providing a variety of rates of movement of either the lift, deck or drive functions by the use of the switches, since once a switch is depressed, movement begins at a predetermined rate. While the platform may ramp up to a particular speed to allow for a smooth operation of the platform, the ramp up rate is not readily adjustable.

Figure 3:
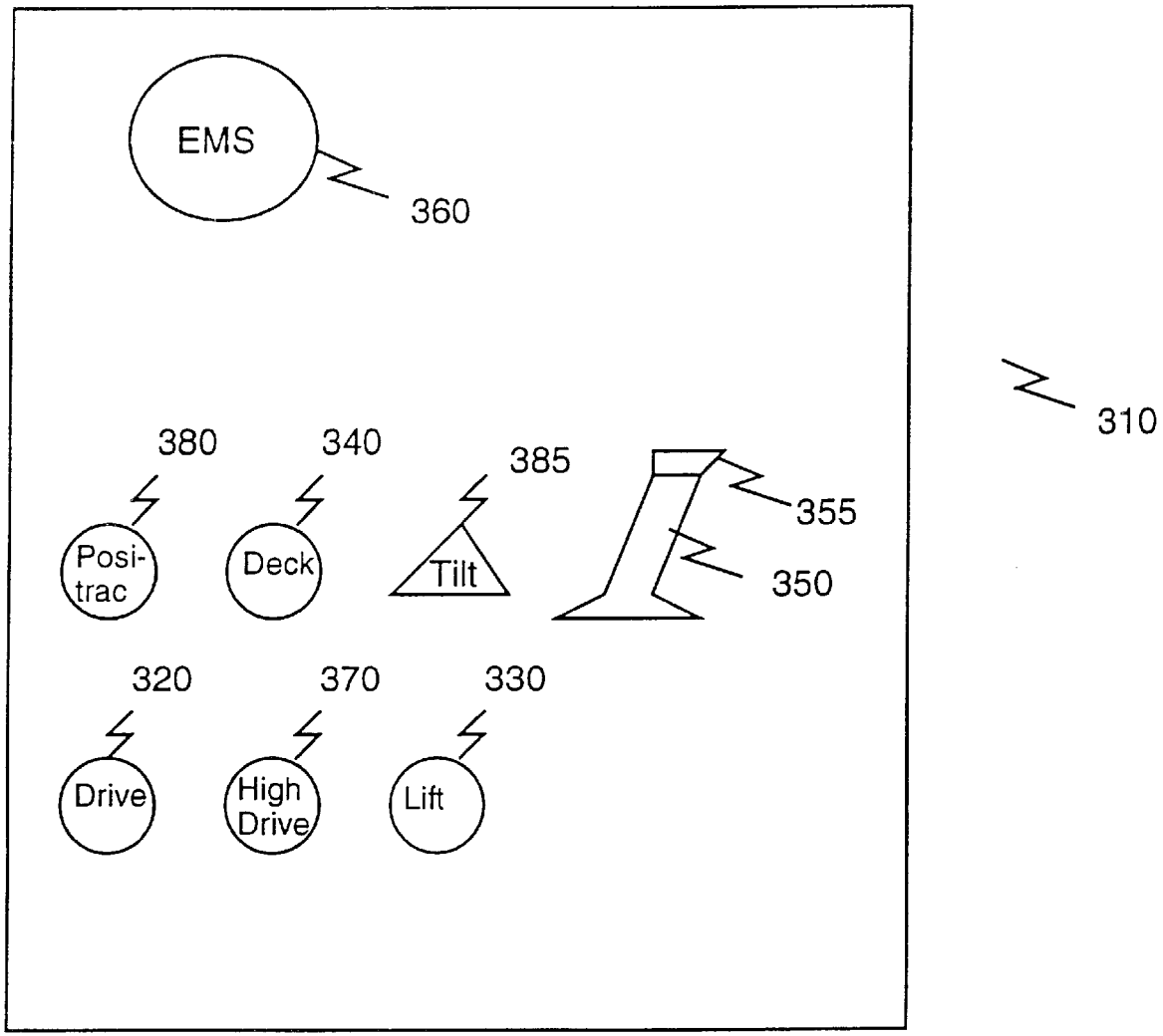
FIG. 3 is a plan view of a platform control station for a scissor type aerial work platform of the system according to the invention (with the joystick shown in a side view for clarity)

A platform control device according to the invention is shown in FIG. 3. The platform control station 310 includes three momentary membrane push buttons 320, 330, 340, which are used to control the drive, lift and deck functions, respectively. The platform control station 310 also includes a joystick 350 which provides control of the forward and reverse movement of the work platform, via the wheels on the base of the work platform. The joystick 350 is spring loaded, so that it will return to a central, or neutral position, when the operator releases the joystick 350.

Situated on the top of the joystick 350 is a rocker switch 355, which provides steering of the wheels of the work platform. The joystick 350 and the rocker switch 355 can be operated simultaneously to provide for a turning function for the work platform. The platform control station 310 also includes an emergency stop device 360, which is configured as a large red button on the top portion of platform control station 310. In order to prevent inadvertent operation of the work platform, an enable function is also incorporated into each of the function select membrane push buttons 320, 330, 340 of the platform control station. A tilt indicator 385 lights up when the work platform is in a tilted condition (i.e., on a ramp).

In a system according to the invention, a microprocessor housed in a controller located at the base portion receives signals from the platform control station through a multiplexing device. The multiplexing device is located at the movable platform portion and is provided to reduce the number of conductors, or communication lines, required between the platform control station and the microprocessor. This saves weight and reduces the size of the control cable that connects these two devices. The multiplexing device in this embodiment according to the invention allows eight separate signals to be transmitted through a single conductor, with one of the signals being a spare reserved for future use. Of course, the number of input signals can change based on the different types of signals received through the multiplexing device, and still be within the scope of the invention.

In order to operate a particular function of the work platform, the operator must depress one of the three available momentary membrane switches 320, 330, 340 on the platform control station 310. When one of the momentary membrane push buttons is selected, a coded signal is sent to the microprocessor via the output line of the multiplexing device. The microprocessor is programmed to recognize the desired function that was selected based on the received coded signal, and activates that function if the directional control (i.e., joystick) is activated within a specified time frame after the desired function was selected. If the directional control is not activated within the specified time frame, the microprocessor will time out and will disable all functions. In one example, the microprocessor also locks out all other primary functions, permitting only one to be active at a single time. That is, either the drive mode, the lift mode, or the deck mode may be entered at any given time, but one cannot perform two separate modes of operation simultaneously. In one example, the specified time frame is three seconds, but the microprocessor can be programmed such that the time frame is set to another time period, say four seconds, and still be operative with the system according to the invention.

Figure 4:
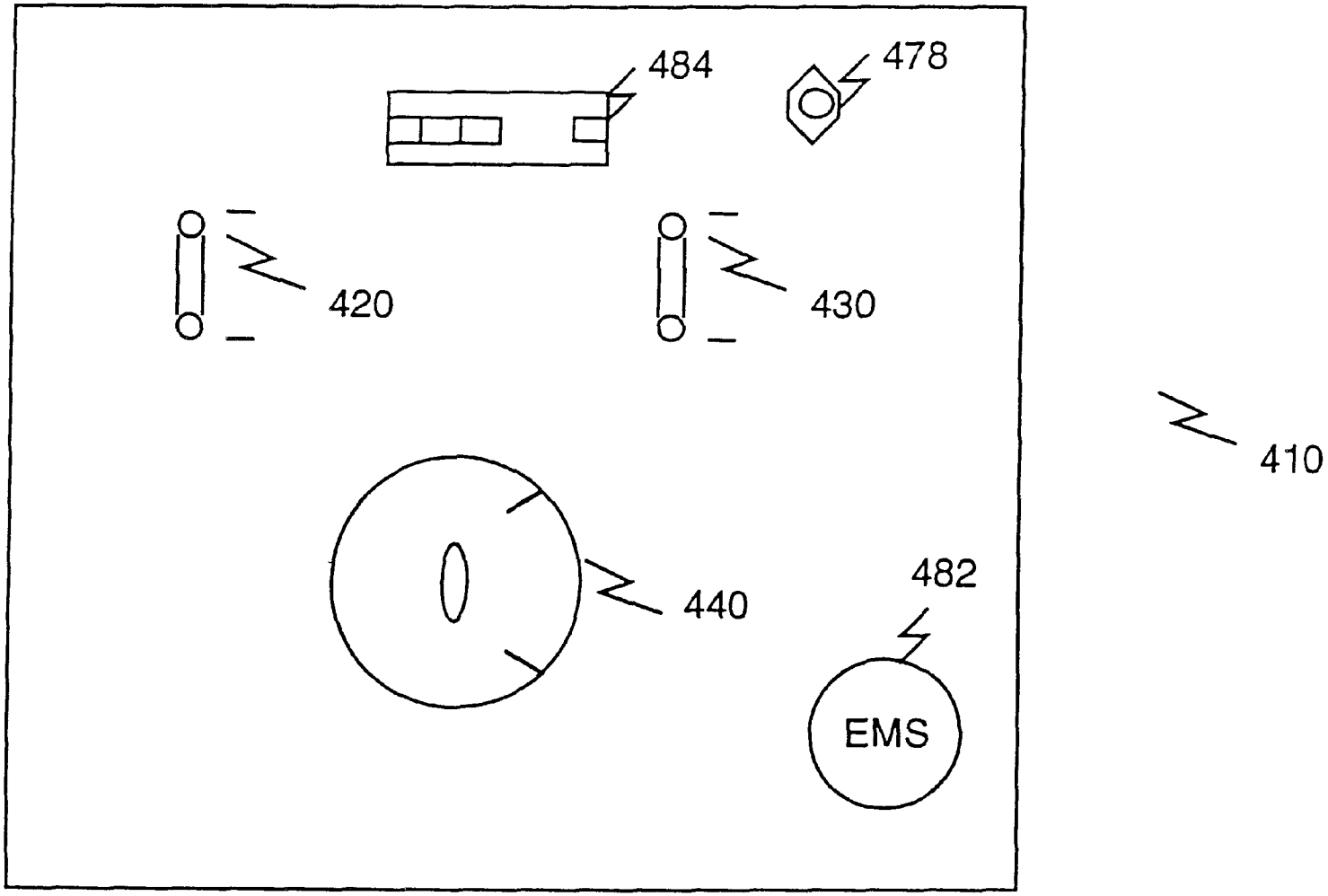
FIG. 4 is a plan view of a ground control station of the system according to the invention.

The ground control station 410 is located on the base portion 20 of the work platform 10. Referring to FIG. 4, the ground control station 410 includes two function switches 420, 430 that control the lift movement and the powered deck movement, respectively. The ground control station 410 allows certain movements of the work platform without an operator having to be on the movable platform 30. Drive control of the work platform is not allowed at the ground control station 410, due to safety reasons. A keyed selector switch 440 is also included at the ground control station 410, and it provides power to either the platform control station 310 or the ground control station 410. When the keyed selector switch 440 is selected and maintained at the ground control position, a function can be activated only at the ground control station. When the keyed selector switch 440 is selected and maintained at the platform control position, a function can be activated only at the platform control station 310. When the keyed selector switch 440 is not in either the platform control position or the ground control position, then the operation of the work platform is not allowed at either the ground control station 410 or the platform control station 310. The ground control station 410 also includes a circuit breaker 478, an emergency switch (EMS) 482, and an optional hour meter 484.

The microprocessor is also programmed to analyze all safety inputs before activating a function, in order to provide safe operation of the work platform. If all safety conditions are met, the microprocessor provides power to an electric motor to enable movement of the work platform. The microprocessor controls the speed of the work platform, based on the input of the accelerator, which is based on the movement of the joystick from a neutral (center) position. The microprocessor is also programmed to activate a particular control valve to allow operation of a particular function.

The microprocessor monitors the safe operation of the aerial type work station through various safety input devices. If an unsafe operation condition is determined, the microprocessor will either terminate or alter operation of a function and/or send a warning to the operator (either visually or audibly, or both).

The packaging of the control module provides modular assembly for the control cable, electric motor, ground control station and control valves to enable quick assembly and replacement, thereby greatly reducing the possibility of incorrect wire termination. The system according to the invention contains built-in diagnostic capability as well as the ability to customize parameters to alter the speed and/or smoothness for a particular chosen function for the scissor type aerial platform.

One feature of the system according to the invention is that it minimizes the number of auxiliary components required to control an aerial platform. This reduction is due to the use of the controller module, as will be described in more detail hereinbelow.

Typically, work platforms can be controlled by using either a platform control station located on a deck (i.e., movable portion) of the work platform, or via a ground control station located at a base (i.e., non-movable portion) of the work platform. As a safety matter, when operation of the work platform via the ground control station is utilized, deck and lift movements are allowed, but drive movement of the work platform itself is not allowed. At the platform control station, there are located three membrane-type push buttons (320, 330, 340 of FIG. 3) for respectively selecting the drive movement, deck movement and lift movement of the work platform. There is also located a joystick (350 of FIG. 3) that is operational to perform the actual movement of the drive, deck and lift, once the appropriate momentary membrane push button has been selected. The joystick is shown operatively in FIG. 5 as a potentiometer 510, in which the further out the joystick is stroked, the greater the rate of movement of the selected drive, deck or lift function.

In the drive mode, the joystick allows either forward movement or reverse movement of the work platform. In one example, the joystick is a single-axis device, which can only be pushed in a forward direction (i.e., 12 o'clock direction when viewed directly above the joystick) or a reverse direction (i.e., 6 o'clock direction). Steering of the work platform is accomplished by holding down the rocker switch located at the top of the joystick (see FIG. 3). The amount of time the rocker switch is held down corresponds to movement of the front wheels of the work platform to a desired turning direction. To move the front wheels in a leftward direction, the left side of the rocker switch is held down, and to move the front wheels in a rightward direction, the right side of the rocker switch is held down. In the lift mode, the joystick allows either an up movement (12 o'clock position) or a down movement (6 o'clock position). In the deck mode, the joystick allows either an extend movement (12 o'clock position) or a retract movement (6 o'clock position).

Figure 5:
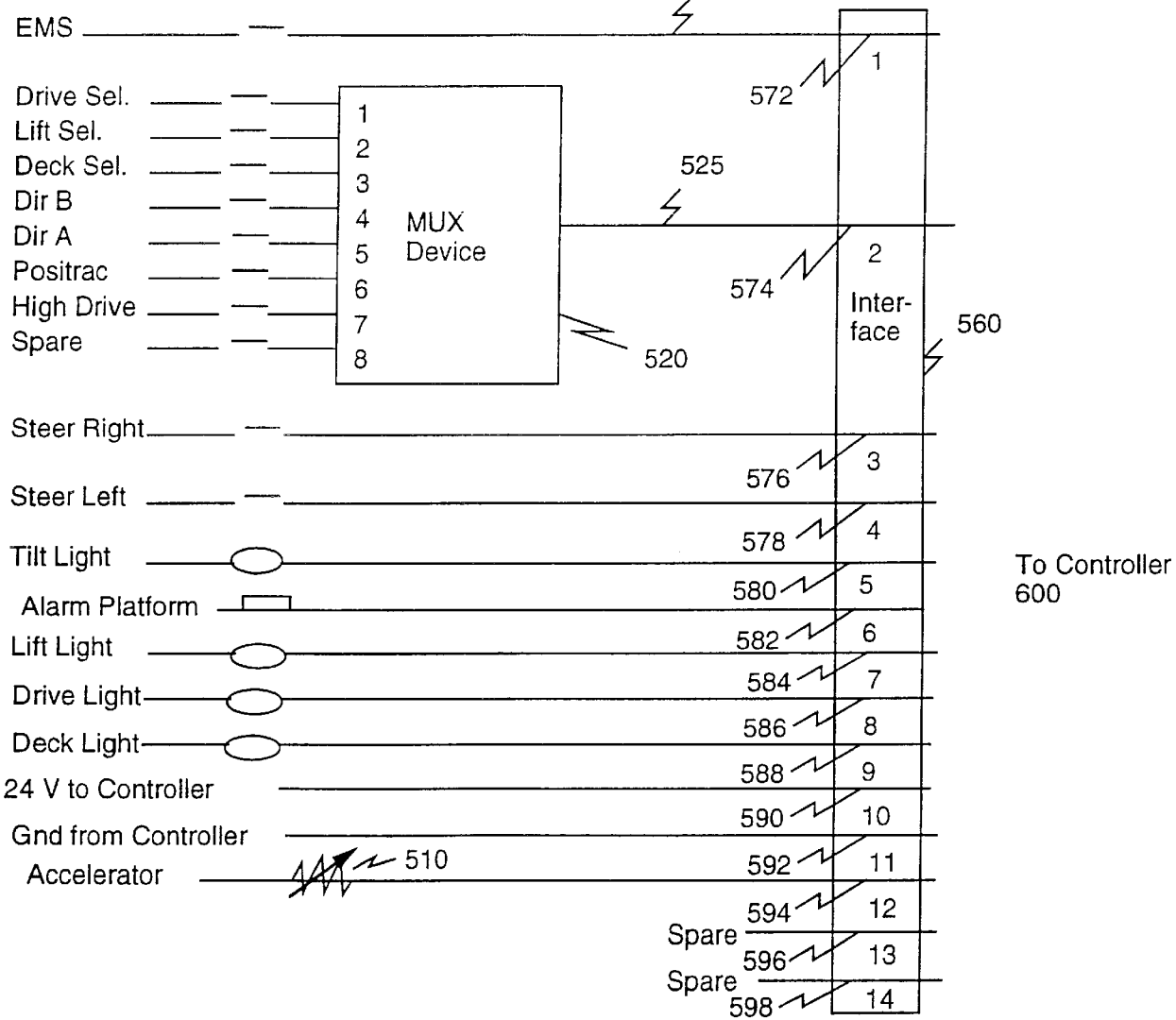
FIG. 5 is a block diagram of the connectivity between the platform control station, the multiplexing device, the interface unit, and the controller of the system according to the invention.

Also shown in block diagram form in FIG. 5 is an eight-input, one-output multiplexing device 520. The multiplexing device 520 receives various inputs from the platform control station 310. Each of the inputs corresponds to a respective signal received from a particular function on the platform control station 310. These signals are used to indicate if a corresponding function on the platform control station 310 has been selected by an operator.

When none of the inputs on the platform control station 310 are activated by the operator, each of the eight input ports of the multiplexing device 520 receives a respective signal in a low state (i.e., 0 volts). When an input on the platform control station 310 is activated by the operator, its respective signal transitions to a high state (i.e., +24 volts). The respective signal is maintained at the high state for a period of time corresponding to the time which the operator holds the switch closed.

Figure 6A:
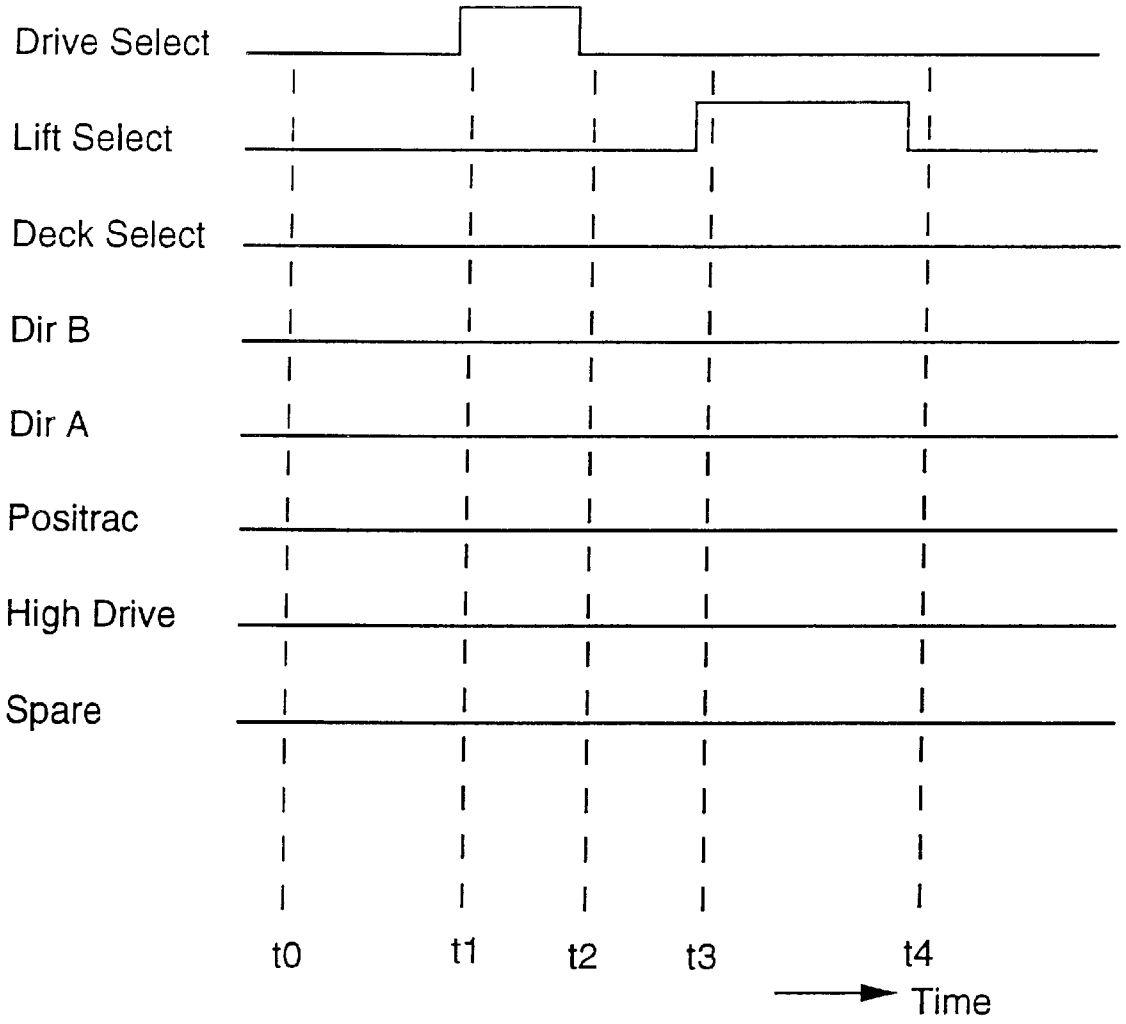
FIG. 6*a* is a timing diagram of various pulse trains arriving at input ports of the multiplexing device of the system according to the invention.

FIG. 6*a* gives an example of the respective signals corresponding to each of the inputs of the platform control station 310. As seen in FIG. 6*a,* at an instant in time t0, none of the inputs are activated by the operator. At a time t1, the drive select momentary membrane push button is activated by the operator, as seen by its respective signal transitioning to the high state. At time t2, the respective signal for the drive select momentary membrane push button transitions back to the low state, indicating that the operator has stopped pressing the drive select momentary membrane push button. At time t3, the respective signal for the lift select momentary membrane push button transitions from the low state to the high state, indicating that the lift select momentary membrane push button has been pressed by the operator. At time t4, the respective signal for the lift select momentary membrane push button transitions back to the low state, indicating that the operator has stopped pressing the lift select momentary membrane push button.

The multiplexing device 520 receives the respective signals from each of the inputs on the platform control 310 on respective input ports. The multiplexing device 520 outputs a train of pulses on an output port. Each pulse in the pulse train corresponds to one of the inputs on the platform control station 310. That is, the first pulse corresponds to the drive select momentary membrane push button, the second pulse corresponds to the lift select momentary membrane push button, etc. When none of the inputs on the platform control station 310 are activated by the operator, the multiplexing device 520 receives all of the respective signals on its eight input ports at a low state. The multiplexing device 520 outputs a train of eight successive pulses, each having a same pulsewidth and a same height, as seen by the pulse train corresponding to t0+Δ in FIG. 6*b*. The eight pulses correspond to the signals received at the eight input ports of the multiplexing device 520.

Figure 6B:
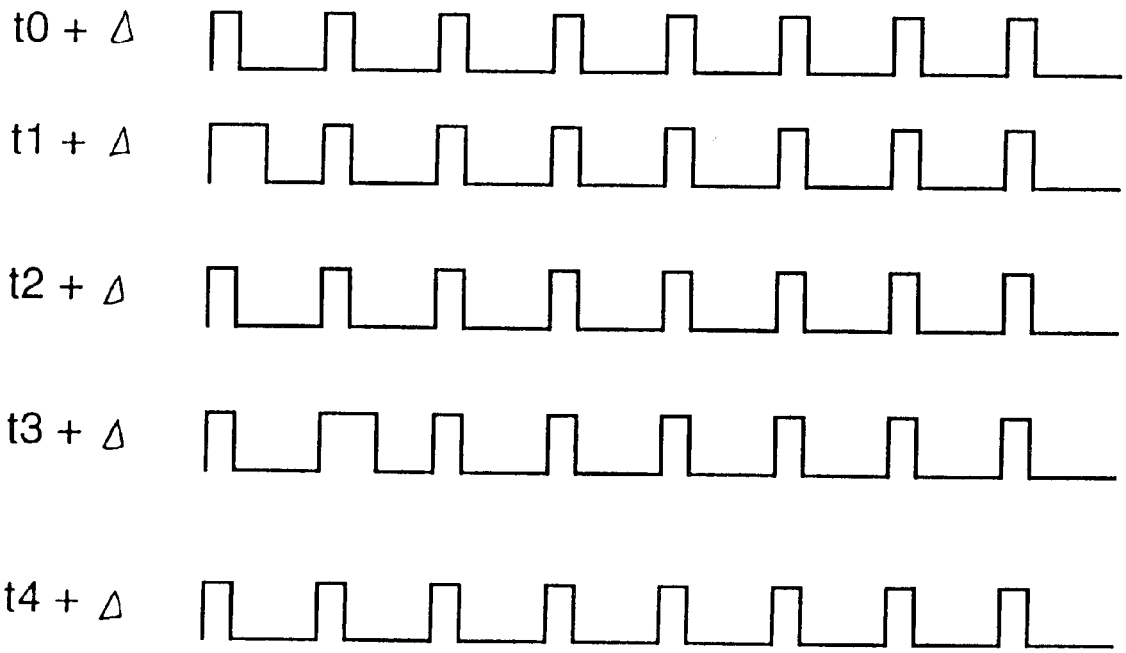
FIG. 6*b* is a timing diagram of the output signal line of the multiplexing device of the system according to the invention.

When the drive select momentary membrane push button is activated at time t1, as indicated in FIG. 6*a,* the multiplexing device 520 outputs a train of eight pulses, with the first pulse in the train having twice as large a pulsewidth as the other pulses in the train, as seen by the pulse train corresponding to t1+Δ in FIG. 6*b*. This pulse train is received by the microprocessor via the interface 560, and it indicates to the microprocessor that the drive select momentary membrane push button has been selected.

When the drive select momentary membrane push button is deactivated at time t2, as indicated in FIG. 6*a,* the multiplexing device outputs a train of eight pulses of equal pulsewidth, as seen by the pulse train corresponding to t2+Δ in FIG. 6*b*.

When the lift select momentary membrane push button is activated at time t3, as indicated in FIG. 6*a,* the multiplexing device 520 outputs a train of eight pulses with the second pulse in the train (corresponding to the lift select momentary membrane push button) having twice as large a pulsewidth as the other seven pulses, as seen by the pulse train corresponding to t3+Δ in FIG. 6*b*.

When the lift select momentary membrane push button is deactivated at time t4, as indicated in FIG. 6*a,* the multiplexing device outputs a train of eight pulses of equal pulsewidth, as seen by the pulse train corresponding to t4+Δ in FIG. 6*b*.

Note that if more than one input is simultaneously selected by the operator at the platform control station 310, then more than one pulse in the eight-pulse output pulse train of the multiplexing device 520 will have the larger pulsewidth size. That is, if both the drive select and lift select momentary membrane push buttons are pressed at the same time by the operator, then the multiplexing device 520 will receive inputs on its first two inputs ports at a high state. The multiplexing device 520 will output an eight-pulse train with the first two pulses in the pulse train having the large pulsewidth size, and the last six pulses having the normal pulsewidth size.

Based on the movement of the joystick, the Dir A (forward or 12 o'clock position) input or the Dir B (reverse or 6 o'clock position) input to the multiplexing device may be set to a high state due to the operator input.

Dir A corresponds to forward (for drive mode), up (for lift mode), and extend (for deck mode) , and Dir B corresponds to reverse (for drive mode), down (for lift mode), and retract (for deck mode). The acceleration function, as well as the Dir A and Dir B functions, are incorporated into the joystick based on the direction the joystick is moved, as well as the distance from center, or neutral, the joystick is moved. How far the joystick is moved from neutral determines how fast the lift is raised up or down when in the lift mode, how fast the deck is extended or retracted when in the deck mode, or how fast the work platform is moved in a particular direction when in the drive mode.

Operation of the aerial type work platform will now be explained in greater detail. When an operator chooses a particular mode from the available modes of drive, lift, or deck, the operator pushes the appropriate function select momentary membrane push button at the platform. At that instant, the microprocessor receives the coded inputs through the multiplexing device 520, informing it of the function actually selected by the operator. For example, assume that the operator selected the drive mode by pushing the drive select momentary membrane push button. The multiplexing device receives inputs from the drive, lift, and deck select functions (as well as the high drive function, positrac function, Dir A input and Dir B input). This information is passed on through the multiplexing device to the microprocessor via the interface 560. The microprocessor interprets the signals and outputs a control signal through port 8 of the interface 560 at a first predetermined voltage value to turn on an LED to light up the drive select momentary membrane push button. The microprocessor also sets a timer to count up to three seconds, at which time the microprocessor outputs the control signal through port 8 of the interface 560 at a second predetermined voltage value to turn off the lighting on the drive select momentary membrane push button if the joystick has not been stroked in the interim. Ordinarily, the control signal output on port 8 of the interface 560 is set at the second predetermined voltage value, thereby keeping the drive select momentary membrane push button in an unlit state under static (unused) conditions. In other words, the light stays lit for three seconds after the joystick has been returned to neutral.

From the time the drive select momentary membrane push button is lit, the operator has approximately three seconds to move the joystick in a direction to effect drive movement of the work platform. This three second window corresponds to the enable function of the drive select momentary membrane push button, discussed previously. If the joystick is moved out of the neutral position within that three second window, this will be detected by either a Dir A switch (detecting movement of the joystick in the forward direction with respect to the center position) or a Dir B switch (detecting movement of the joystick in the reverse direction). As a result, a signal indicative of the joystick movement is sent to the microprocessor through the multiplexing device 520 and the interface. The microprocessor will then allow drive movement of the work platform. If the joystick is not moved out of the neutral position within the three second window, then the drive mode is not enabled, and the operator must repush the drive select momentary membrane push button to activate this mode at a later time. That is, if the operator moves the joystick four seconds after pressing the drive select momentary membrane push button, the work platform will not move, and the signals received corresponding to the movement of the joystick are ignored.

Figure 7:
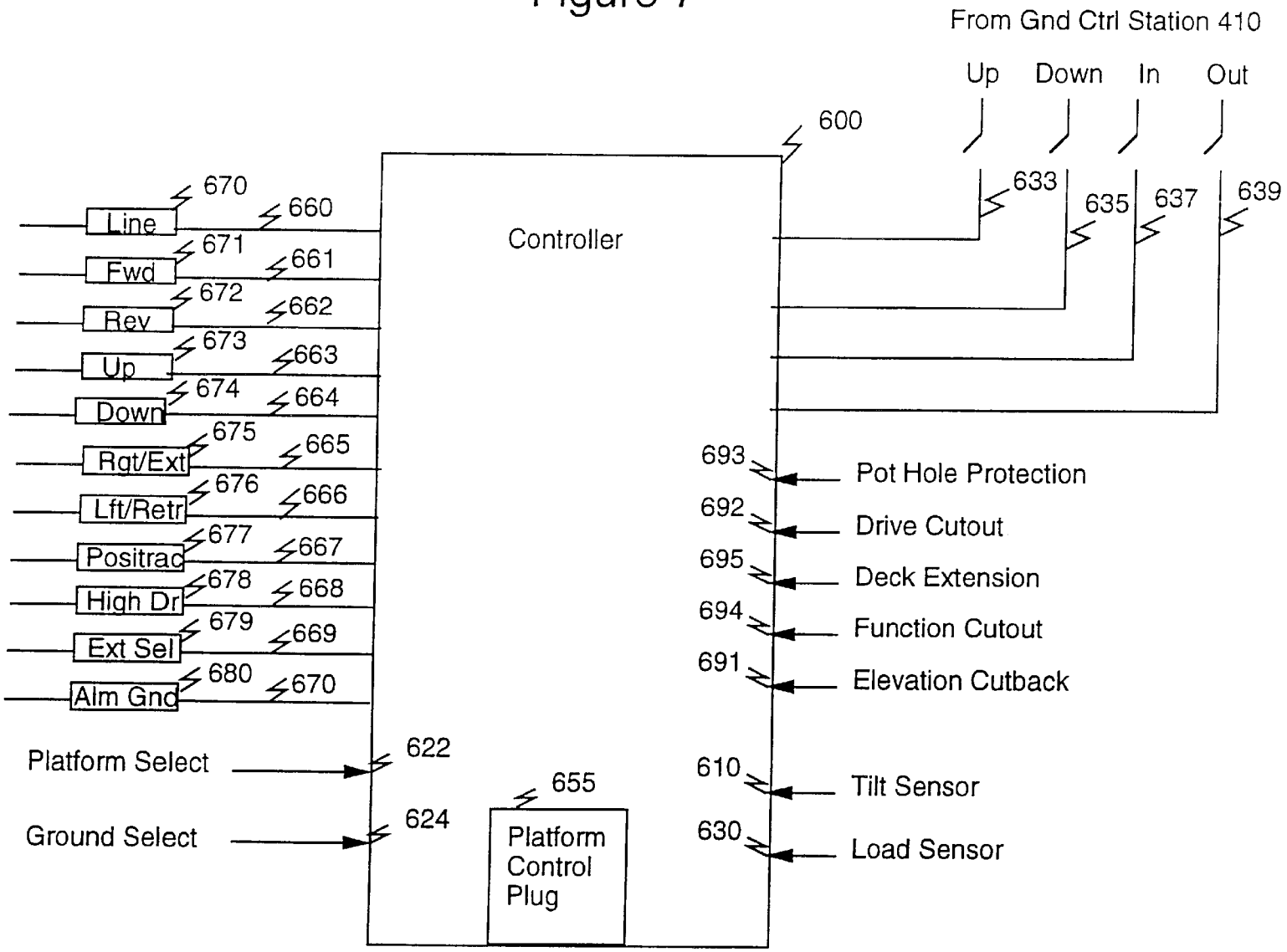
FIG. 7 is a block diagram of the various inputs and outputs of the controller of the system according to the invention.

The controller 600 can also be configured to allow only certain operations to occur based on the current status of the aerial type work platform. As shown in FIG. 7, there are several sensor inputs to the controller 600, such as: Tilt Sensor Input 610 and Load Sensor Input 630. A tilt sensor (not shown) senses the amount of tilt of the work platform, such as when the work platform is going up or down a ramp (i.e., front wheels higher than rear wheels). This tilt condition is relayed to the controller 600 via the tilt sensor input 610. A load sensor (not shown) senses an amount of load being carried by the work platform, and this information is relayed to the controller via the load sensor input 630. Based on one or more of these sensed inputs, the controller 600 determines an appropriate safety mode of operation for the work platform. An angle sensor (not shown) may also be used with the controller 600, and it would sense the height that the platform is at. The angle sensor would relay the height information to the controller 600 via an angle sensor input (not shown). The height is based on the angle of the scissor connections (that allow up and down movement of the platform).

For example, when the work platform is in an elevated position, i.e., when the platform is above a certain height, the controller only allows the operator to move the work platform in the drive mode at 30% of the maximum normal speed of the work platform (the cut back value is software programmable and can be set to any desired value). That way, it reduces the likelihood that the work platform will tilt over due to excessive speed when in the elevated position. In one example, the safety determinations are software programmable, and the microprocessor (internal to the controller 600) determines the safety features by accessing the dedicated safety software stored in memory accessible by the microprocessor. As another example, if the deck is positioned away from the base of the work platform by a certain amount, say three feet "extended", then again the microprocessor will sense this condition, and will not allow a downward movement (i.e., disallow lift down function) until the deck is retracted fully.

As discussed earlier, FIG. 5 shows an interface 560 between the multiplexing device 520 and the controller 600. The interface 560 has 14 ports, two being reserved as spares. The first port 572 is from the emergency stop (ENS) button. When activated, the EMS button causes deactivation of the work platform by removing the connection to the power cable by means of a line contactor, so that no power is made available to the work platform. The second port 574 receives the single conductor output from the multiplexing device 520. The third port 576 is for steer right, and the fourth port 578 is for steer left. These ports correspond to a particular positioning of the rocker arm positioned on the joystick, and they are not fed through the multiplexing device 520. The fifth port 580 is for the tilt light, which is activated by the microprocessor when the tilt sensor port to the controller is tripped. The sixth port 582 is for the alarm platform, which is used to output an alarm (i.e., beeping sound) at the platform to notify the operator of a particular safety problem. The seventh through ninth ports 584, 586, 588 are for the lift light, drive light, and deck light, respectively. Each of these ports pass through signals sent by the microprocessor, in which a light on one of the function select push buttons is activated when the corresponding function select push button is pushed by the operator. The light stays on for the time the function is active.

The tenth port 590 is the power input from the ground control station, which is shown as 24 volts DC in FIG. 5. The eleventh port 592 is the ground input (i.e., zero volts DC) from the ground control station. The twelfth port 594 receives the accelerator input signal from the joystick. The accelerator input signal corresponds to an amount by which the joystick has been moved from its neutral position to either a forward or reverse position. This input is accomplished by a potentiometer 510, which changes resistance based on the amount of movement of the joystick, and by which a proportional amount of current is input to the controller to indicate the position of the joystick. That is, if the joystick is pushed only slightly forward, this will cause a different analog signal to be sent through the twelfth port 594 as compared to a condition when the joystick is pushed all the way forward. A slight push forward on the joystick will cause a slower rate of forward movement of the platform as opposed to when the joystick is pushed all the way forward, in which the maximum allowable forward rate of movement will be effected. A thirteenth port 596 and the fourteenth port 598 are reserved as spares for future use.

Referring now to FIG. 7, the 18 gauge, 14 wire input (for the 14 ports) from the interface 560 is connected to the platform cable 655 plug on the controller 600.

The controller 600 is also configured to detect fault conditions. For example, after the work platform is powered up, if one of the function select push buttons is in a closed position, then a fault is detected, and the work platform will not be allowed to operate until the fault is cleared. The microprocessor also detects permanent closure of one of the function select momentary membrane push buttons, and this is also determined to be a fault. For example, if the operator chooses to select the drive mode by taping the drive select momentary membrane push button to the closed position, this will be indicated by the respective signal at the first input port of the multiplexing device 520 being set to the high state for the period of time during which the drive select momentary membrane push button is in the closed position. The output of the multiplexing device 520 will reflect this condition, which is sent to the microprocessor. This indicates to the microprocessor that the drive select momentary membrane push button is in the closed position for at least a predetermined amount of time, say for greater than ten seconds. If this is the case, then the microprocessor will output a fault condition, disallowing operation of the work platform until the fault is cleared; i.e., the momentary membrane push button is untaped to thereby place it in an open position.

The controller 600 communicates with the platform control station 310 via the interface 560. The controller 600 also receives inputs from the ground control station 410, such as the platform select input 622 and the ground select input 624, as determined by the positioning of the key selector switch (see element 440 of FIG. 4). The controller 600 also receives signals indicative of the up and down lift controls 633, 635 as well as the extend and retract deck controls 637, 639 made via the ground control station 410. The various inputs to the controller 600 as received from both the platform control station 310 and the ground control station 410 are delineated in Table 1, below.

TABLE 1

| Inputs to Controller | |
|---|---|
| | Input from Platform Control |
| Digital Control Inputs | - Drive (MUX) |
| | - Lift (MUX) |
| | - Deck (MUX) |
| | - Dir B (MUX) |
| | - Dir A (MUX) |
| | - Positrac (MUX) |
| | - High Drive (MUX) |
| | - Steer left |
| | - Steer right |
| Analog Control Input | - Motor Speed (5K pot) |
| Other | - Horn (feed thru) |
| | Input from Ground Control |
| Digital Control Inputs | - Elevation Cutback |
| | - Drive Cutout |
| | - Ground Clearance Sw. |
| | - Deck Extension Limit Sw. |
| | - Function Cutout |
| | - Deck Extend |
| | - Deck Retract |

TABLE 1-continued

| Inputs to Controller | |
|---|---|
| | - Lift Up |
| | - Lift Down |
| | - Ground Control Select |
| | - Platform Control Select |
| Analog Control Inputs | - Tilt Switch Input |
| | - Load Input |
| | - Angle Input |

The outputs of the controller 600 are delineated in Table 2, below.

TABLE 2

| Outputs from Controller | | |
|---|---|---|
| Controlled Output | | |
| Ground | - Line Contactor | 1.25 A |
| | - Forward Valve | 1.25 A |
| | - Reverse Valve | 1.25 A |
| | - Lift Up Valve | 1.25 A |
| | - Lift Down Valve | 1.25 A |
| | - Steer/Deck Exten. Valve | 1.25 A |
| | - Steer/Deck Retrac. Valve | 1.25 A |
| | - Positrac | .75 A |
| | - High Drive | .75 A |
| | - Deck Exten. Select | .75 A |
| | - Alarm (Ground) | .75 A |
| Platform | - Tilt Light | .04 A |
| | - Alarm (Platform) | .04 A |
| | - Lift Lamp | .04 A |
| | - Drive Lamp | .04 A |
| | - Deck Lamp | .04 A |

The first ten output signals 660–669 shown on the left side of the controller 600 of FIG. 6 are sent to corresponding devices 670–679 that are controlled by the controller 600 based on the inputs received by the controller 600. The controller 600 also outputs an alarm signal on line **670*a* to an alarm device 680 on the platform control station 310. The alarm device 680 is used to notify the operator of various alarm conditions. Each of the valves 671–679 are on/off valves, which are either fully open or fully closed, based on a corresponding control signal received from the controller 600. For example, if the lift select momentary membrane push button has been selected by the operator, either the up valve or the down valve 673, 674 will be activated by the controller, based on the positioning of the joystick by the operator. The first output is the line contactor 670, which is placed in series with a battery. Based on a condition detected, the controller software activates the line contactor 670 (which is essentially a relay) to disconnect the battery from the work platform, thereby stopping movement of the work platform. For example, if the emergency stop button was pushed, that would cause deactivation of the line contactor 670 by the microprocessor resident in the controller 600**.

The valves used to move the work platform, such as the up, down, forward, and reverse valves 671–674, are controlled by the microprocessor to control the exact movement of the work platform. The controller 600 pulses a pump motor (not shown) appropriately via pulse width modulated (PWM) signals, to allow an amount of hydraulic fluid to flow through the valve, to thereby cause the appropriate movement of the deck, lift or drive of the work platform. Thus, when the forward valve 671 is opened and then the motor is pulsed via a PWM signal output from MOSFETs (not shown) driven by the microprocessor, the pulsewidth of the PWM signal, as controlled by the microprocessor, determines the speed of the drive function. The speed is determined by the amount of movement of the joystick, as input to the controller 600 via the accelerator input through the interface (see FIG. 5). Also, based on other conditions, such as tilt, load, and angle of the work platform, the speed of the work platform may be limited to a predetermined value for safety reasons.

Referring back to FIG. 7, the elevation cutback 691 is an input to the controller 600, and it is used to inform the controller 600 if the movable platform is fully lowered or not. The drive cutout input 692 is used to inform the controller 600 if the movable platform is above a preset elevation. The sensing is via a mechanical switch (not shown) located on the lifting mechanism, and the preset elevation can vary from country to country. The ground clearance lowering input 693 indicates to the controller 600 whether the ground clearance lowering system (not shown) has been activated or not. When activated, the bottom frame 5 of the base portion 20 of the platform (see FIG. 1) is ¾" above the ground, and when not activated, the bottom frame 5 is 3" above the ground. The ground clearance lowering system should automatically engage when the movable platform 30 is lifted up from the fully lowered position. If the ground clearance lowering system is not engaged when the movable platform 30 is not in the fully lowered position, then this is indicated to the controller 600 via the ground clearance lowering input 693, and various functions may be disallowed or cut back as a result of this malfunctioning of the ground clearance lowering system.

The function cutout input 694 is a pressure indication of whether a load on the work platform 10 exceeds a predetermined amount. This can be set to a different value based on the country to which the platform is being used. Based on whether the platform is loaded or not, certain functions may not be allowed (i.e., cut out).

The deck extension input 695 provides an input to the controller 600 as to whether or not the deck is fully retracted.

In FIG. 7, the valves 675, 676 for controlling deck extension and deck retraction also are used to control the steer right and steer left functions, respectively. This is because steering is not allowed when the deck is being moved. Ordinarily, the steer function is activated, and thus the signals output by the controller 600 on lines 665 and 666 control the steering movement of the front tires. However, when the deck select momentary membrane push button has been selected and if the joystick has been stroked by the operator within the predetermined time frame (3 seconds), then output signals on lines 665 and 666 control the deck extension and retraction of the work platform, respectively. Thus, in the deck mode, any movement of the rocker switch located on the joystick will not result in a steering movement. The sharing of the two valves 675, 676 is controlled by a selector valve (not shown), which is configured such that when the deck mode is selected, the hydraulic fluid that would ordinarily be sent to move the front tires of the work platform to effect a steering function would be redirected to a path to extend or retract the deck. In one example, the deck can be extended to a maximum of 4 feet or 6 feet, depending upon the model of the work platform.

Based on the software configurability of the system according to the invention, speeds of various functions may be controlled based on the sensed inputs. The location from which the operator input is being received, and the country within which the work platform is being used. For example, if the lift mode is selected in the ground control station, the speed of the lifting may be programmed to be only 50% of what it would be if selected in the platform control station. Also, if a tilt condition is detected, the lifting may be cut out. Since each country has different safety standards, the system according to the invention can be easily programmable to accommodate the safety requirements of a particular country. For example, in most countries, if the deck is extended, the work platform cannot be sent down in the lift mode, and the operator must first retract the deck fully before being allowed to move the platform in a downwardly direction. However, in Italy, a downward movement of the platform is allowed if the deck is extended and the platform is above a predetermined height. So, a work platform being used in Italy would have its controller programmed to allow for such a condition to be allowed.

Alternatively, if the work platform is being used at an airport, the controller may be programmed to prevent deck extension above a predetermined rate, so that inadvertent contact with an airplane being repaired will be lessened to a great extent. That is, for work platforms used at an airport, the rate of movement in the deck extension mode may be curtailed to a greater degree than for a work platform in a typical warehouse. However, deck retraction may allowed up to the normal rate for work platforms used at an airport.

Another feature is the use of momentary membrane push buttons at the platform control station. In conventional devices, high currents are typically required to be sent to conventional controllers when a switch on a conventional platform control device is actuated. However, by using the multiplexing device connected to a microprocessor in a controller, the amount of current required to be sent to the microprocessor is lower than what it would be for the conventional system, which requires terminal strips (or blocks), relays and diodes. For example, milliamperes of current are all that is required to send signals to the microprocessor. This is at least an order of magnitude less than the current requirements in conventional controllers. With this lessening of the input current requirements, membrane-type push buttons can be utilized in the system according to the invention.

The functionality of each of the control functions will now be described in greater detail. The line contactor control provided by the controller 600 is used to turn on or off the line contactor 670 at appropriate instants in time. When the work platform is powered on, all function select push buttons should be open. If any are closed, then all functions will be inoperative and a fault will be indicated on the platform control station and the ground control station (i.e., fault LED is blinking). Releasing the closed function by the operator will clear the fault. When the work platform is powered up, all functions are operative if: a) the accelerator (joystick) is selected in a three second window after a function select push button has been momentarily closed, or b) any other function was operated less than three seconds before.

When a function is operated, intermittent closure of a momentary membrane push button is ignored. Permanent closure of a momentary membrane push button for more than ten seconds (programmable to any other value, if desired) will trigger a fault to be indicated. However, the function is allowed to continue until it is terminated, then all functions will be inoperative.

Referring now to FIGS. 5 and 7, the drive forward input on input port 5 of the multiplexing device 520 is used by the controller 600 to control the operation of the forward valve 671 when the drive mode is activated. When selected (i.e., when the joystick is pushed in the forward direction during the drive mode), the forward valve 671 is powered and the motor ramps up to the selected forward speed. The rate at which the motor ramps up or down is software adjustable. Further, the rate at which the motor ramps up or down for each of the different functions (i.e., drive, lift and deck) can be set independently of the ramp up/down rates for other functions. The speed may be either full speed, cut back speed, or variable input speed, depending on the safety mode of operation, as determined by the controller 600. When released (i.e., when the joystick is released), the motor slows down to a stop, and then the forward valve 671 is switched off. Suppression (i.e., a diode, not shown) across the coil of the valve 671 is incorporated in the control of the valve 671 by the controller 600.

The drive reverse input on input port 4 of the multiplexing device 520 is used by the controller 600 to control the operation of the reverse valve 672 when the drive mode is activated. When selected (i.e., when the joystick is pushed in the reverse direction during the drive mode), the reverse valve 672 is powered and the motor ramps up to the selected reverse speed. The rate at which the motor ramps up or down is software adjustable. The speed may be either full speed, cut back speed, or variable input speed, depending on the safety mode of operation, as determined by the controller 600. When released (i.e., when the joystick is released), the motor slows down to a stop, and then the reverse valve 672 is switched off. Suppression (i.e., a diode) across the coil of the valve 672 is incorporated in the controller 600.

The elevation cutback input 691 is an input to the controller 600. When deselected, the maximum drive speed is reduced to a cut back preset level (software programmable) and the high drive coil is deactivated. The elevation cutback input 691 is deselected when the aerial platform is not in the fully lowered position, and it is selected otherwise. If the elevation cutback input is in the selected mode, then no speed cutback based on elevation is performed by the controller 600.

The drive cutout input 692 is also an input to the controller 600. When deselected, the drive is cut out completely. When selected, the drive is not cut out. The drive cutout input 692 may be deselected when the aerial platform is above a preset elevation.

The ground clearance lowering input 693 is another input to the controller 600. When deselected, the ground clearance lowering system is not engaged, and when selected, the ground clearance lowering system is engaged.

The function cutout input 694, when activated, causes cutout of certain operator functions. The function cutout input 694 is activated when the pressure on the work platform is above a preset amount, indicating a heavy load being carried by the work platform, and thus the need to be in a safe mode of operation.

When tilt of the work platform is detected, as given by the tilt sensor input 610, the tilt light is activated, via a control signal sent out by the controller 600 through port 6 of the interface 560.

Table 3 lists the various controller responses based on the drive cutout input, the elevation cutback input and the ground clearance lowering input. Based on any combination of these inputs, various functions may be allowed, cut back, or disallowed.

TABLE 3

Drive Speed Table

| Drive Cutout Input | Elevation Input | Gnd Clearance Input | Controller Response |
|---|---|---|---|
| 0 | 0 | 0 | Cutout Drive |
| 0 | 0 | 1 | Cutout Drive |
| 0 | 1 | 0 | Cutout Drive |
| 0 | 1 | 1 | Cutout Drive |
| 1 | 0 | 0 | Cutout Drive |
| 1 | 0 | 1 | Cutback Speed |
| 1 | 1 | 0 | Full Drive |
| 1 | 1 | 1 | Full Drive |

Other functions that can be enabled at the platform control station include the high drive function and the positrac function. Each of these functions has a corresponding momentary membrane push buttons 370, 380 on the platform control station 310, as shown in FIG. 3. The high drive function allows for an increased speed of the work platform, such as a maximum speed of 3 mph instead of 1½ mph when in the normal drive mode. To select the high drive function, the operator must first push the drive select momentary membrane push button 320, and then push the high drive momentary membrane push button 370. At this point, the operator is in the high drive mode, and must activate the joystick 350 to effect movement of the work platform, or the high drive function will be disenabled. If the operator is already in the drive mode, when the high drive momentary membrane push button 370 is pushed, the high drive mode will be enabled. When activated, the high drive mode will remain active until the drive function is terminated, or unless the motor current reaches or exceeds 130 amperes (adjustable via software control) for a preset time (also software adjustable). If the motor current reaches or exceeds 130 amperes for a preset time, this indicates excessive strain on the drive motor (such as going up a hill), and the high drive function will be deactivated by the controller. The high drive function is enabled by the controller 600 sending a signal on line 668 to open the high drive valve 678 (FIG. 7), which allows twice as much hydraulic fluid through it as the normal drive valve (valve 671 or 672 of FIG. 7) allows. This results in the work platform being able to move at a faster rate.

The positrac function can be selected at the platform control station when in the drive mode by the operator pushing the positrac momentary membrane push button 380 (see FIG. 3). When selected, the positrac valve 677 (see FIG. 7) is powered by the controller 600 (via a signal sent on line 667) for as long as the positrac momentary membrane push button 380 is held down, plus an additional predetermined amount of time after the positrac momentary membrane push button 380 is disengaged. This predetermined amount of time is programmable from a minimum of 10 seconds after the positrac momentary membrane push button 380 is disengaged to a maximum of 300 seconds after the positrac momentary membrane push button 380 is disengaged. Of course, when the work platform is not in the drive mode and the positrac momentary membrane push button 380 is pushed, the positrac mode will not be entered and that input through the multiplexing device 520 will be ignored by the controller 600. The positrac mode allows for an equal amount of power to be supplied to each of the drive wheels of the work platform, and can be useful when climbing over a minor obstruction, or when traversing over uneven pavement, such as gravel. If the operator repushes the positrac momentary membrane push button 380 at anytime during the software-programmable predetermined amount of time, say, 100 seconds, after the positrac momentary membrane push button 380 is disengaged, say, for example, within 5 seconds after the positrac momentary membrane push button 380 was released, then the predetermined amount of time is restarted from zero, thereby increasing the time in the positrac mode. That is, with the example given above, at the time the positrac momentary membrane push button 380 is repushed, the operator will be in the positrac mode for another 100 seconds.

When either the drive select, lift select, or deck select momentary membrane push buttons are pressed by the operator, their respective membrane push buttons light up for an amount of time during which the function is active. The high drive and positrac momentary membrane push buttons do not light up when pressed by the operator.

When the deck mode is entered, a selection valve (not shown) becomes activated, and it diverts oil from the steer right and steer left valves to the deck extend and deck retract valves, respectively. In essence, during the deck mode, the steer right and steer valves 675, 676 become the deck extend and deck retract valves, due to operation of the selection valve. When the operator wants to perform deck extension by pushing the joystick in a forward direction during the deck mode, the valve 675 is powered, and the motor ramps to a speed selected (full or variable input) within a preset delay (software adjustable). The ramp up/down speed is software adjustable, as in the case with the ramp up/down speeds for the drive mode. When the joystick is released, the motor slows to a stop and the valve 675 closes. Suppression (i.e., a diode) across the coil of the valve 675 is incorporated in the control of the valve 675 by the controller. When the drive mode is selected or if either the lift mode or the deck mode are not enabled, the valve 675 operates as to perform a steer right function when steer right is selected (i.e., when the rocker switch is held on its right side during the drive mode or when no mode is selected).

When the operator wants to perform deck retraction by pushing the joystick in a reverse direction during the deck mode, the deck retraction valve 676 is powered, and oil is sent through the deck retraction valve 676 and not the steer left valve by the selection valve being activated. The motor ramps to a speed selected (full or variable input) within a preset delay (software adjustable). When the joystick is released, the motor slows to a stop and the valve 676 closes. Suppression (i.e., a diode) across the coil of the valve 676 is incorporated in the control of the valve 676 by the controller 600. When the drive mode is selected or if either the lift mode or the deck mode are not enabled, the valve 676 operates as to perform a steer left function when steer left is selected (i.e., when the rocker switch is held on its left side during the drive mode or when no mode is selected).

When the lift mode is enabled and the joystick is stroked in a forward direction, the lift up valve 673 is powered via a signal sent from the controller 600 on line 663, and the motor ramps up to the speed selected (full speed or variable input) within a preset delay (software adjustable). When the joystick is released, the motor slows down to a stop, and then the valve 673 is switched off via a signal sent on line 663. Suppression (i.e., a diode) across the coil of the valve 673 in incorporated in the control of the valve 673 by the controller 600.

When the lift mode is enabled and the joystick is stroked in a reverse direction, the lift down valve 674 is powered, and the motor ramps up to the speed selected (full speed or variable input) within a preset delay (software adjustable). When the joystick is released, the motor slows down to a stop, and then the valve 674 is switched off. Suppression (i.e., a diode) across the coil of the valve 674 in incorporated in the control of the valve 674 by the controller 600. If the deck extension limit switch is active, the lift down function will be disabled by the controller 600.

When the drive mode is selected, the potentiometer/joystick controls the speed of the motor in drive mode. The control is proportionally controlled from a minimum speed (software adjustable) to a maximum preset speed (software adjustable). This is also true for the lift mode and the deck mode as well. The drive speed may also be set to the cut back selected speed, depending on the inputs received from the various sensors connected to the controller 600 (i.e., aerial platform is elevated above the preset height).

The controller 600 also provides various types of platform alarms. In a first condition, when the tilt sensor is tripped and the elevation cutback switch is open, the alarm on the platform is sounded continuously. This alarm condition is enabled by machine digits, which will be explained more fully hereinbelow. In a second condition, when the function cutout input is open, the alarm is sounded for two seconds, then off for two seconds. This alarm condition is enabled by a machine digit. This on/off cycle is continued until the overload condition is corrected. In a third condition, when the deck extension limit switch is open and the operator attempts a downward movement in the lift mode, the alarm is sounded with the following cycle: one second on, one second off, one second on, and three seconds off. This alarm condition is also enabled by machine digits. This cycle is continued only while the operator attempts a downward movement in the lift mode.

The machine digits correspond to a set of eight digits that are set for each work platform. The eight digits are used to inform the controller 600 about which options have been set for a particular work platform. Based on the machine digits, the controller 600 sets the default ramp up and down rates for the drive, lift and deck modes, for example. In the system according to the invention, the first machine digit corresponds to the model number of the work platform, and can be set to any of six possible values (i.e., the first machine digit is actually three binary digits that can denote any of six possible states). The second machine digit corresponds to the angle at which the tilt switch is activated, and it can be set to any of five possible states (0—no tilt switch, 1=5 degree tilt switch, 2=2 degree tilt switch, 3=2 degree tilt switch when active cuts out lift up and drive when elevated, 4=5 degree tilt switch when active cuts out lift up and drive when elevated).

The third machine digit corresponds to the power deck mode (0=no power deck, 1=power deck). The fourth machine digit corresponds to information concerning the deck extension limit switch, and can be set to one of three possible states (0=no deck extension limit switch, 1=cuts out lift down when active, 2=cuts out lift down when active if above elevation). The fifth machine digit corresponds to information concerning the function cutout input to the controller, and can be set to one of four possible states (0=no function cutout, 1=cuts out all functions when active, 2=cuts out lift up and drive when active, 3=cuts out all lift and drive functions when active). The sixth machine digit corresponds to information concerning the ground alarm, and can be set to one of four possible states (0=no ground alarm, 1=active when lift down is active, 2=active when drive is active, 3=active when lift, drive or deck is active). The seventh machine digit corresponds to information concerning the angle sensor (0=no angle sensor, 1=angle sensor). The eight machine digit corresponds to information concerning the load sensor (0=no load sensor, 1=load sensor). Of course, the above description of machine digits can be changed and modified to suit other types of work platform conditions and still be within the scope of the invention.

The load sensor input 630 produces an analog (or digital) input to the controller 600, which is used in conjunction with the angle sensor input to cut out certain operating functions, as determined by the controller 600. The angle sensor input 620 produces an analog input to the controller 600, and it is used in conjunction with the load sensor input 630 to cut out certain operating functions, as determined by the controller 600.

As stated earlier, the drive, lift and deck functions are preferably not operated in conjunction with one another. In the case that two functions are selected by the operator simultaneously, the controller 600 will output a fault condition. In any other case, the last selected function will be available in a three second window, if direction is selected.

The steer function will always be active except during the lift and deck modes. A fault will occur if a function is selected and the joystick/accelerator is not in the neutral position. If a function is active and another function is selected, the second selection will be ignored.

Table 4 gives the details of the various country specifications and options, as used in the system according to the invention. Of course, the list may change to suit the various standards of these countries, and still be within the scope of the invention.

TABLE 4

| Country Settings |
|---|
| Domestic Options |
| - Drive Cutout |
| - Tilt Switch 5 degrees |
| - Deck Extension Switch |
| - Function Cutout |
| Latin American Spec |
| - Tilt Switch 5 degrees |
| European Spec |
| - Drive Cutout |
| - Tilt Switch 2 degrees |
| French Spec |
| - Overload |
| - Drive Cutout |
| - Deck Extension Switch |
| Italian Spec |
| - Drive Cutout |
| - Deck Extension Switch |
| Japan Spec |
| - Function Cutout |
| - Tilt Switch 5 degrees |
| Aust. Spec. |
| - Tilt Switch 2 degrees |
| - Drive Cutout |

Function Cutout—a) French—cuts out lift and drive functions when open; b) Japan—cuts out lift up and drive functions when open.

Deck Extension Switch—a) French—cuts out lift down; b) Italian—cuts out lift down only when below drive cutout.

Tilt Switch—Aust., Japan, Latin America—cuts out lift up and drive when above elevation and tilted.

Table 5 lists the various adjustments that can be either factory preset and/or customer adjustable with a hand held adjuster, as used in one embodiment of the invention.

TABLE 5

| Adjustments | | |
|---|---|---|
| -1- | Drive Acceleration Delay | 1.5 |
| -2- | Drive Deceleration Delay | 1.0 |
| -3- | Lift Acceleration Delay | 2.0 |
| -4- | Lift Deceleration Delay | 1.5 |
| -5- | Deck Extension Acceleration Delay | 2.0 |
| -6- | Deck Extension Deceleration Delay | 1.0 |
| -7- | Drive Creep Speed | 4.0 |
| -8- | Lift Creep Speed | 10 |
| -9- | Deck Creep Speed | 10 |
| -10- | Steering Creep Speed | 20 |
| -11- | Steering Drive Speed Compensation | 5 |
| -12- | Drive Speed Maximum | 100 |
| -13- | Lift Speed Maximum | 100 |
| -14- | Deck Extend Maximum | 80 |
| -15- | Deck Retract Maximum | 100 |
| -16- | Elevation/Drive Cut Back | 20 |
| -17- | Positrac Holding Time | 10 |
| -18- | Machine Model | 1 |
| -19- | Ground Control Lift Up Speed | 25 |
| -20- | Ground Control Lift Down Speed | 20 |
| -21- | Ground Control Deck In Speed | 30 |
| -22- | Ground Control Deck Out Speed | 30 |
| -23- | High Drive Overcurrent | 130 |
| -24- | High Drive Overcurrent Time Out | 2.5 |

Machine Model (This adjustment will automatically set all the default adjustment/selection of the specific model number).

Machine digits configure optional features, using PC interface or analyzer.

Certain functions are set via machine digits. These machine digits may be provided via an RS-232 interface on the controller, to which a personal computer (PC) may be connected, or to which an analyzer may be connected. The analyzer is a hand-held device, and it performs the same diagnostic functions as can be performed by a PC, but is less expensive and more compact. The analyzer includes an LCD alphanumeric display of two rows of 16 characters each, including prompts. The analyzer also includes six buttons that allow for function selection: a) LEFT (select previous menu item or previous digit for multi-digit entries), b) RIGHT (select next menu item or next digit for multi-digit entries), c) UP (increase selected item or digit, if allowed), d) DOWN (decrease selected item or digit, if allowed), e) ENTER (selects displayed item, if allowed; completes multi-digit entries), and f) ESC (cancels select item, if allowed; cancels multi-digit entries). For the analyzer utilized in the system according to the invention, the LEFT, RIGHT, UP and DOWN buttons are indicated by arrows pointing in a particular direction for the corresponding buttons.

When the analyzer is turned on, the main menu will become available. From the main menu, all functions can be selected. Pressing the LEFT or RIGHT buttons will select between the various items, pressing the ENTER button will select the displayed item, and pressing the ESC, UP or DOWN buttons will have no effect. The main menu items are: a) ACCESS LEVEL, b) DIAGNOSTICS, c) PERSONALITIES, d) MACHINE SETUP, and e) MACHINE DIGITS.

When ACCESS LEVEL is displayed, it is followed by the current access level (one of a plurality of access levels). In one example, Access Level 3 is the initial level, which gives 'view-only' access. Access Level 2 can be selected by entering an appropriate code, and allows certain personalities to be altered. Access Level 1 can be selected by entering an appropriate code, and allows additional personalities to be altered, as well as allowing the machine setup to be changed. Access Level 0 cannot be entered from the analyzer, and is reserved for setting up the work platform at the manufacturing facility.

When the DIAGNOSTICS item is selected, five diagnostic menu items are displayed: a) platform, b) ground, c) power, d) long-term, and e) fault code. Selecting one of these items gives access to diagnostic information relating to the selected item. For example, if the platform item is selected, one can obtain information on the accelerator input.

When the PERSONALITIES item is selected, one of two menu items are available: a) platform and b) ground. Selecting 'platform' gives access to personalities relating to the platform control mode, and selecting 'ground' gives access to personalities relating to the ground control mode.

When the MACHINE SETUP item is selected, six machine setup items are available: a) model number, b) tilt switch, c) power deck, d) deck extension limit, e) function cutout, and f) ground alarm. Each item displays its machine digit number as well as the meaning of the digit.

The MACHINE DIGITS menu item is only available when access level 1 has been selected. In this menu, all of the machine setup digits are displayed together.

The choice of the particular machine digits allows one to configure the work platform to suit the particular jobs required for the work platform.

Table 6 shows the various terminals supplied with the controller 600. Diagnostics are provided by the controller 600 by way of a single LED, which will flash a preset amount of times, related to the fault which has occurred (i.e., three flashes for a power fault, four flashes for a microprocessor fault). An analyzer may also be hooked up to the controller 600. The analyzer will be in the form of a handset, which includes the features outlined above.

Table 6—Controller Terminals

3 Power Terminals (1/4–20 stud) to connect to Battery Positive, Battery Negative, and the Motor.

1 Plug, 15 pos., to accept the 18/14 cable plug coming from the control box.

1 Plug, 12 pos., to accept the ground control valves.

1 Plug, 6 pos., to accept the ground control switches.

5 Plug, 2 pos., to accept the 18/2 cable plug coming from the speed cut back switch, drive cut-out switch, deck extension switch, ground clearance lowering switch, and function cut-out switch.

3 Plug, 3 pos., to accept the cable coming from the tilt input, angle input, and the load input switches.

1 Plug, 4 pos., for the RS-232 link.

The PC or the analyzer can also be used to gain access to a particular programming level of the work platform by entering an appropriate password to the controller via the RS-232 port. For example, four levels of access can be envisioned, in which the fourth level allows one to view the various ranges of operation modes allowable, but the operator is not allowed to modify those ranges. At a third level, certain modes of operation may be modified to some extent, such as drive acceleration rate, lift acceleration. At a second level, more modes of operation may be modified, such as all of the modes of operation of the third level, as well as high drive current limit, elevation cutback speed. At a first level, virtually all modes of operation may be modified. The first level can only be accessed by users who set up the work platform prior to it being shipped to a particular location. Based on a password entered via the RS-232 interface from the PC or the analyzer, an operator may enter any of the four levels described above to change an operating characteristic of the work platform.

While there has been illustrated and described what is at present considered to be exemplary embodiments according to the invention, it will be understood by those skilled in the art that various changes and modifications may be made, and equivalents may be substituted for elements thereof without departing from the true scope of the invention. In addition, many modifications may be made to adapt to a particular situation or material to the teachings of the invention without departing from the central scope thereof. Therefore, it is intended that this invention not be limited to the particular embodiments disclosed as the best mode contemplated for carrying out the invention, but that the invention will include all embodiments falling within the scope of the appended claims.

What is claimed is:

1. A work platform having a controller, the work platform including:

a base section capable of drive movement along a surface; and a movable platform section capable of separate movement with respect to the base station, the controller comprising:

an input unit coupled to the work platform, the input unit being configured to receive a plurality of sensed inputs that are indicative of a state of the work platform, the state including at least one of a load on the work platform, a height of the movable platform section, and an angular position of the work platform;

a switching unit coupled to the work platform, the switching unit being capable of being positioned in one of a first position and a second position, the switching unit configured to allow operator inputs to operate the work platform from only a ground control station located on the base section when the switching unit is in the first position, and to allow operator inputs to operate the work platform from only a platform control station located on the movable platform section when the switching unit is in the second position; and a control unit coupled to the work platform, for responding to the received sensed inputs and the operator inputs, for operating the work platform in one of a plurality of predetermined conditions, wherein, when the switching unit is in the first position, all operator inputs from the platform control station are ignored by the control unit, and when the switching unit is in the second position, all operator inputs from the ground control station are ignored by the control unit, the controller further comprising:

a plurality of input units for receiving a plurality of signals corresponding on a one-to-one basis to a plurality of available operator selections; and a multiplexing unit, provided between the platform control station and the control unit, said multiplexing unit receiving the plurality of signals from the plurality of input units respectively, and said multiplexing unit outputting a plurality of pulses corresponding to the plurality of signals to the control unit at the same time.

2. The work platform having a controller as recited in claim 1, wherein said control unit includes a microprocessor programmable to allow different predetermined conditions.

3. The work platform having a controller as recited in claim 1, the controller further comprising an input port configured to receive a plurality of binary digits indicative of the plurality of predetermined conditions, wherein said controller accesses an internal memory to determine said predetermined conditions based on said binary digits.

4. The work platform having a controller as recited in claim 3, wherein said plurality of binary digits are stored in said internal memory, and wherein said controller further comprises a digital port provided to receive a different set of binary digits in order to reprogram said predetermined conditions to a different set of predetermined conditions.

5. The work platform having a controller as recited in claim 1, the controller further comprising a single output line for the multiplexing unit.

wherein the plurality of pulses are output by said multiplexing unit onto the single output line and placed in different temporal positions within a particular frame, and wherein, when one of the plurality of signals is in an operative state, a corresponding one of the pulses is also placed in an operative state by said corresponding one of said input units changing a state of the corresponding one of the pulses with respect to the state of the corresponding one of the pulses when the one of the plurality of signals is in an inoperative state.

6. The work platform having a controller as recited in claim 5, wherein the plurality of input units are operable such that two or more of the plurality of pulses have changed states in a particular frame when their corresponding ones of the plurality of signals input by way of the corresponding ones of the input units are in the operative state.

7. The work platform having a controller as recited in claim 5, wherein the plurality of input units are operable such that the state of the corresponding one of the pulses is maintained with the state for as long as the corresponding one of the signals remains in the operative state.

8. The work platform having a controller as recited in claim 1, wherein the control unit provides control such that a drive movement of the work platform and a lift movement of the movable platform section are allowed from the platform control station, and wherein the control unit provides control such that lift movement of the movable platform section is allowed but the drive movement of the movable platform section is not allowed from the ground control station.

9. A work platform having a controller, the work platform including:

a base station capable of drive movement along a surface; and a movable platform section capable of separate movement with respect to the base station, the controller comprising:

a platform control station coupled to the movable platform section for controlling operation of the work platform from the movable platform section;

a ground control station coupled to the base station for controlling operation of the work platform from the base station;

an input unit coupled to the work platform, the input unit being configured to receive a plurality of sensed inputs that are indicative of a state of the work platform, the state including at least one of a load on the work platform, a height of the movable platform section, and an angular position of the work platform;

a switching unit coupled to the base station, the switching unit being capable of being positioned in one of a first position and a second position, the switching unit configured to allow operator inputs to operate the work platform from only lie ground control station when the switching unit is in the first position, and to allow operator inputs to operate the work platform from only the platform control station when the switching unit is in the second position; and a control unit coupled to the work platform, for responding to the received sensed inputs and the operator inputs, for operating the work platform in one of a plurality of predetermined conditions, wherein, when the switching unit is in the first position, all operator inputs from the platform control station are ignored by the control unit, and when the switching unit is in the second position, all operator inputs from the ground control station are ignored by the control unit, the controller further comprising:

a plurality of input units for receiving a plurality of signals corresponding on a one-to-one basis to a plurality of available operator selections; and multiplexing unit, provided between the platform control station and the control unit, said multiplexing unit receiving the plurality of signals from the plurality of input units, respectively, and said multiplexing unit outputting a plurality of pulses corresponding to the plurality of signals on a single output line to the control unit at the same time.

10. The work platform having a controller as recited in claim 9, wherein the platform control station includes:

a joystick being operable in a single-axis direction;

a drive select switch for moving the work platform along a surface on which the work platform is situated;

a lift select switch f or lifting the movable platform section in a vertical direction; and a deck select switch f or moving a deck portion of the movable platform section in a horizontal direction.

11. The work platform having a controller as recited in claim 10, wherein said ground control station includes:

a first switch configured to move the movable platform in one of an up and down direction; and a second switch configured to move the deck portion in one of an extend and retract direction, wherein said ground control station does not allow for driving or steering of the work platform on the surface.

12. The work platform having a controller as recited in claim 9, wherein said control unit includes a microprocessor programmable to allow different predetermined conditions.

13. The work platform having a controller as recited in claim 9, the controller further comprising an input port configured to receive a plurality of binary digits indicative of the plurality of predetermined conditions, wherein said controller accesses an internal memory to determine said predetermined conditions based on said binary digits.

14. The work platform having a controller as recited in claim 10, wherein said platform control station further includes:

a rocker switch positioned on a top of said joystick and operable to be moved to one of a right and a left position, said right position causing rightward movement of forward tires on the base portion of the work platform to allow for a right turn, and said left position causing leftward movement of the forward tires on the base portion of the work platform to allow for a left turn.

15. The work platform having a controller as recited in claim 14, wherein the joystick is in a resting position when not operated, wherein the joystick is operable in a forward direction along the single-axis direction with respect to the resting position to provide forward movement of the work platform, and wherein the joystick is operable in a rearward direction along the single-axis direction with respect to the resting position to provide rearward movement of the work platform.

16. The work platform having a controller as recited in claim 15, wherein the joystick and the rocker switch are both capable of being operated at the same time to provide for one of a forward and rearward turning movement of the work platform.

17. The work platform having a controller as recited in claim 15, wherein one of the plurality of input units receives a drive select signal that indicates whether movement of the work platform is desired or not, and wherein the control unit allows one of forward and rearward movement of the work platform only when the joystick is operated within a predetermined period of time after the drive select signal indicates that movement of the work platform is desired.

18. The work platform having a controller as recited in claim 15, wherein movement of the joystick at an increased distance with respect to the resting position is received by the control unit, which provides control such that the work platform moves at a greater rate of speed than when the joystick is closer to the resting position.

* * * * *